US010060194B2

(12) United States Patent
Scheibelmasser et al.

(10) Patent No.: US 10,060,194 B2
(45) Date of Patent: Aug. 28, 2018

(54) DRILL PIPE

(71) Applicants: Anton Scheibelmasser, Graz (AT); Bouchra Lamik-Thonhauser, Gai (AT); Anton Kotov, Samara (RU); Michael Korak, Kindberg (AT); Johann Jud, Kindberg (AT); Manfred Gutschelhofer, Langenwang (AT); Alexander Fine, Leoben (AT)

(72) Inventors: Anton Scheibelmasser, Graz (AT); Bouchra Lamik-Thonhauser, Gai (AT); Anton Kotov, Samara (RU); Michael Korak, Kindberg (AT); Johann Jud, Kindberg (AT); Manfred Gutschelhofer, Langenwang (AT); Alexander Fine, Leoben (AT)

(73) Assignee: THINK AND VISION GMBH, Leoben (AT)

( * ) Notice: Subject to any disclaimer, the term of this patent is extended or adjusted under 35 U.S.C. 154(b) by 173 days.

(21) Appl. No.: 14/380,762

(22) PCT Filed: Feb. 25, 2013

(86) PCT No.: PCT/AT2013/000035
§ 371 (c)(1),
(2) Date: Aug. 25, 2014

(87) PCT Pub. No.: WO2013/126936
PCT Pub. Date: Sep. 6, 2013

(65) Prior Publication Data

US 2015/0041216 A1 Feb. 12, 2015

(30) Foreign Application Priority Data

Mar. 1, 2012 (AT) ..... A 265/2012

(51) Int. Cl.
*E21B 17/02* (2006.01)
*E21B 47/06* (2012.01)
*E21B 17/00* (2006.01)

(52) U.S. Cl.
CPC ..... *E21B 17/003* (2013.01); *E21B 17/028* (2013.01); *E21B 47/06* (2013.01)

(58) Field of Classification Search
CPC ..... E21B 17/003; E21B 17/028; E21B 47/06
See application file for complete search history.

(56) References Cited

U.S. PATENT DOCUMENTS 3,906,435 A * 9/1975 Lamel ..... G01H 1/10 175/50
4,836,305 A * 6/1989 Curlett ..... E21B 17/003 175/215

(Continued)

FOREIGN PATENT DOCUMENTS

AT 504 294 4/2008
AT 508 272 12/2010

(Continued)

OTHER PUBLICATIONS

International Search Report dated Nov. 5, 2013, corresponding to PCT/AT2013/000035.

(Continued)

*Primary Examiner* — David J Bagnell
*Assistant Examiner* — Michael A Goodwin
(74) *Attorney, Agent, or Firm* — Young & Thompson

(57) ABSTRACT

A drill pipe (1), particularly for a drill string, has at least one electrical conductor (4, 7, 8, 9) and an inner pipe (2) which is arranged inside the drill pipe (1). The drill pipe (1) and the inner pipe (2) are spaced at a distance to one another in sections, wherein the drill pipe (1) and inner pipe (2) bound (Continued)

a hollow space (3). At least one electrical conductor (4, 7, 8, 9) is arranged on one outer side of the inner pipe.

17 Claims, 3 Drawing Sheets

(56) References Cited

U.S. PATENT DOCUMENTS

| | | | | |
|---|---|---|---|---|
| 4,949,797 | A * | 8/1990 | Isom | E21B 17/003 175/215 |
| 4,953,636 | A | 9/1990 | Mohn | |
| 5,060,737 | A | 10/1991 | Mohn | |
| 8,342,865 | B2 | 1/2013 | Scheibelmasser et al. | |
| 2011/0217861 | A1* | 9/2011 | Scheibelmasser | E21B 17/028 439/271 |

FOREIGN PATENT DOCUMENTS

| | | | |
|---|---|---|---|
| DE | 1 230 382 | | 12/1966 |
| DE | 10 2010 018 383 | | 10/2011 |
| EP | 0 257 744 | | 3/1988 |
| EP | 0 296 788 | | 12/1988 |
| FR | 2 613 741 | | 10/1988 |
| GB | 2353148 | * | 2/2001 |

OTHER PUBLICATIONS

Austrian Search Report dated Jan. 14, 2013, corresponding to the Foreign Priority Application No. A 265/2012.

* cited by examiner

DRILL PIPE

BACKGROUND OF THE INVENTION

Field of the Invention

The invention relates to a drill pipe, in particular for a drill string, with at least one electrical conductor and an inner pipe, which is arranged inside the drill pipe.

Description of the Related Art

An essential element in modern crude oil, natural gas or geothermal energy drilling is data acquisition during the drilling process ("Measurement While Drilling" (MWD), "Logging While Drilling" (LWD)). The same also applies, however, for the construction of the borehole ("Well Site Construction") or the subsequent crude oil, gas, or hot water production. Only by the acquisition of the respective, relevant measurement values can a drilling be operated reliably, efficiently, and economically. A problem develops both in the case of real-time data transmission ("online data transmission") of measurement data to the surface and in the case of the energy supply ("power supply") of the underground measurement units from the surface. From several kilometers deep, the data are to be transmitted at a high data rate (e.g., 200 kBaud); the underground measurement units are to be supplied above ground with power (e.g., 200 W).

In this case, the risk of explosion represents one of the biggest problems. In particular, the only conditionally predictable occurrence of gas accumulations must in this case be taken into account. For the wiring of drill pipes, special precautions are thus to be taken that prevent the development of any ignition sparks or the latter can occur only in explosion-proof areas.

Proposed solutions in which the individual elements of the drill string are only inductively coupled to one another, i.e., no open electrical conductors or contacts are present, avoid this problem, but neither can the desired data rates be achieved nor can underground consumers be supplied with power. There is therefore a need for a solution that makes it possible to connect drill string elements or drill pipes galvanically to one another. To this end, both suitable solutions for the coupling of individual drill string elements or drill pipes and for the wiring of drill pipes are themselves necessary. The former is achieved by the device for connecting electrical conductors according to AT 508 272 B1.

BRIEF SUMMARY OF THE INVENTION

The object of the invention is thus to provide a solution for the wiring inside a drill pipe or drill string.

This object is achieved by a drill pipe of the above-mentioned type, which is characterized in that the drill pipe and the inner pipe are at a distance from one another in places, by which drill pipe and inner pipe bound a hollow, and in that at least one electrical conductor is arranged on an outer side of the inner pipe.

By this arrangement, the wiring is protected in two different ways. On the one hand, the environment outside of the drill pipe is protected against the electrical conductor, since the latter is separated from the environment. On the other hand, conditions that impose special requirements on the materials used and lead to rapid wear and tear, from which the conductor is also protected, prevail both inside a drill string and outside of it.

Because the drill pipe is at a distance from the inner pipe in places, a hollow is produced between the two. A filler can be located in the latter according to a preferred embodiment of the invention. However, the hollow can also be empty. As a result, any deformations of the inner pipe, which can be caused by the drilling fluid conducted at very high pressure through the inner pipe, can be counteracted. In addition, if necessary, vibrations or oscillations can be damped by suitable filler, which can occur during the operation, or the drilling fluid can be insulated thermally from the surrounding area of the drill pipe.

As an alternative, according to a preferred embodiment, the filler can be used for sensor purposes, since various measurable properties of the filler change based on conditions prevailing in the pipe and around the pipe. In this case, both properties that correlate directly with the environment, such as, for example, pressure and temperature, as well as those that correlate only indirectly with the environment, such as, for example, the electrical conductivity of the filler, can be measured.

According to a preferred embodiment, the electrical conductor is arranged on the outside of the inner pipe. The fastening in this case must be carried out so that the conductor and the inner pipe are electrically insulated from one another, since the latter is generally manufactured from a conductive material, for example, steel.

By a direct attachment of the conductor to the inner pipe, changes of the inner pipe, in particular changes in length, for example by heat expansion, or the operating weight, can be transmitted directly to the conductor. As a result, the conductor itself can comply with sensor purposes, for example for measuring the length of the drill string as described in AT 504 294 A.

According to a quite especially preferred embodiment, the electrical conductor is connected, for example glued, to the inner pipe on the outer side of the inner pipe preferably over the entire length of the conductor. Ideally, the conductor itself maintains the shape of a section of a pipe. In addition, the conductor is thus removed a little or not at all from the shape of a pipe or a section. Thus, for the given space offered, as large a conductor cross-section as possible can be achieved, by which the electrical resistance of the conductor is kept as low as possible. If multiple conductors are desired, for example, electrically insulating guides can be provided, by which the conductor is divided, depending on length, into partial conductors, e.g., halved or quartered. Thus, the number of conductors can be matched to the requirements, and/or in each case, a different object can be assigned to different conductors. For example, six conductors can be provided, of which two are used for power supply of consumers and four as data conductors. Two conductors, one as a forward conductor and one as a return, which are used both as power conductors and as data conductors, are preferably used.

Independently of or in addition to the above-mentioned embodiments, at least one electrical and/or electronic device is arranged according to another preferred embodiment of the invention in the hollow. The latter can perform various functions. On the one hand, sensor tasks can be accomplished according to a preferred embodiment of the invention, i.a., the different properties of the filler or the conductor itself, as described above, measure or, for example, detect the position or location of the drill string with a location sensor. On the other hand, for example, it can be used as a signal booster, e.g., for data signals coming into the drill head from adjacent drill string elements or instruments.

According to another alternative or additional preferred embodiment, an electronically readable input/output, in particular a chip, is arranged in the hollow, and the electronically readable input/output is connected via a switch to the electrical conductor. Thus, individual drill pipes, on the one hand, can be identified at any time, but, on the other hand, information, such as, for example, the time of the last maintenance of the drill pipe, can be stored directly in the drill pipe. In this case, for example, a warning can be issued when maintenance of a drill pipe is already overdue.

Additional preferred embodiments of the invention are the subject matter of the other subclaims.

BRIEF DESCRIPTION OF THE DRAWINGS

The invention is further explained below with reference to the drawings. Here.

DETAILED DESCRIPTION OF THE PREFERRED EMBODIMENTS

A drill pipe 1 according to the invention has an inner pipe 2, a hollow 3 between the outer body of the drill pipe 1 and inner pipe 2, and at least one conductor 4, 7, 8, 9. The drill pipe 1 consists of steel in this embodiment.

Figure 1:
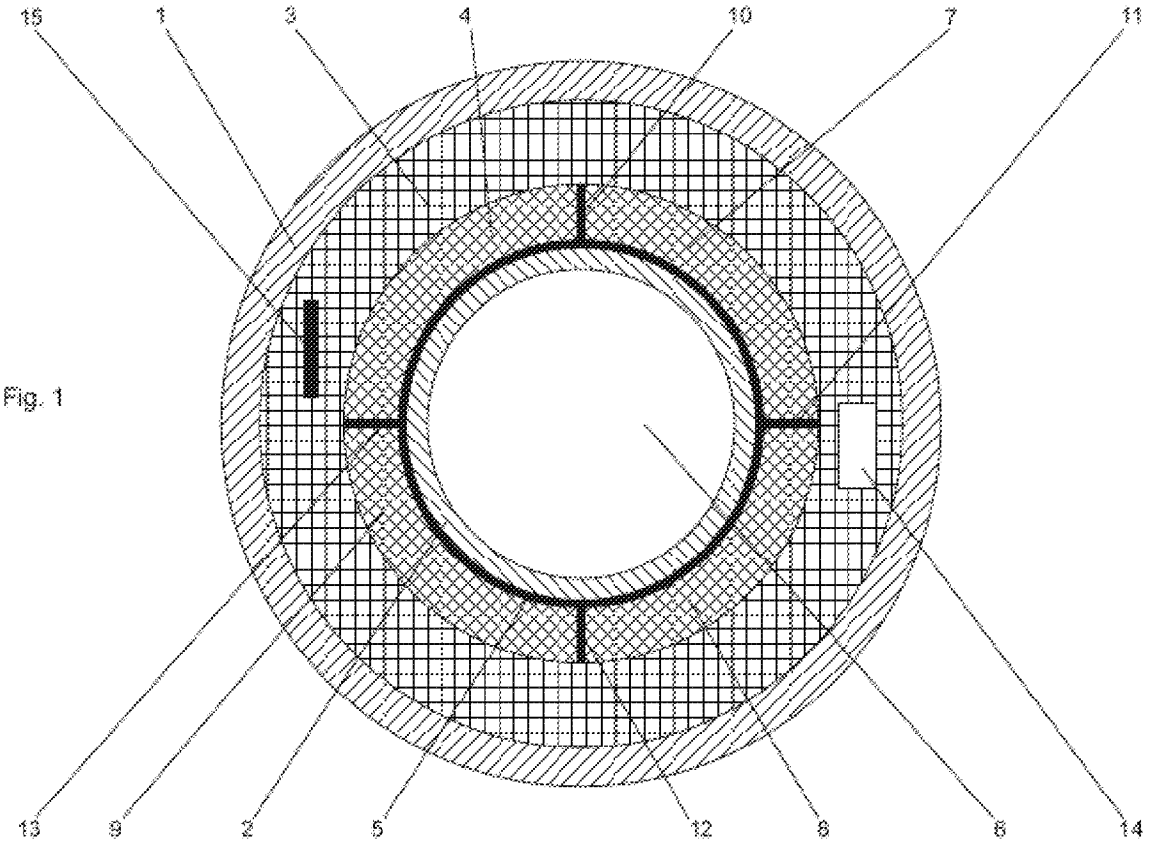
FIG. 1 shows a schematized cross-section through an embodiment of a drill pipe according to the invention with four conductors.

In heavily schematized form, FIG. 1 shows in section the design of a drill pipe 1 according to the invention. The inner pipe 2 is electrically insulated outward by insulation 5. The latter is primarily necessary when an electrically conductive or electrostatically rechargeable material is used for the inner pipe 2. Since materials that can withstand the special conditions in the case of drilling must be selected for the inner pipe 2, usually steel, i.e., an electrically conductive material, is used for this purpose. Without insulation 5, an inner space 6 of the inner pipe 2 would be exposed to an increased risk of explosion or the risk of a short-circuit. Should an electrically non-conductive material, for example a carbon fiber-reinforced plastic, be used for the inner pipe 2, the insulation 5 between the conductors 4, 7, 8, 9 and the inner pipe 2 could also be eliminated. In the embodiment depicted, four conductors 4, 7, 8, 9, which are insulated from one another in each case by insulating guides 10, 11, 12, 13, are located in the insulation 5. In this example in each case, the conductors 4, 7, 8, 9 have the shape of quarter-pipe segments. Embodiments in which only one tubular conductor 4 is provided are also conceivable, such as those in which other numbers, for example two, three, five or more, of conductors 4, 7, 8, 9 are provided. The possibility also exists of arranging simple round or flat conductors in the inner pipe.

In the embodiment, the hollow 3, which essentially extends over the entire length of the drill pipe and preferably is filled with a filler, is located between the inner pipe 2 with the conductors 4, 7, 8, 9 and the drill pipe 1. The hollow is sealed on both ends by a seal 26, 27 (FIG. 3) in each case. The filler is preferably fluid or free-flowing. The filler can consist of, for example, resin, silicone oil, sand, glass, or ceramic or can contain these materials. Should a filler that is electrically conductive be selected, it is also necessary to introduce insulation on the side of the conductors 4, 7, 8, 9 facing the drill pipe. In any case, such insulation is also useful to avoid damage to the conductors 4, 7, 8, 9 during installation. In this sense, embodiments in which the conductors 4, 7, 8, 9 are taken up partially or completely in the material of the inner pipe 2 are also conceivable.

In the depicted embodiment, an electrical device 14 and an electronically readable input/output 15 are arranged in the hollow 3, surrounded by filler. Both are connected to at least one conductor 4, 7, 8, 9, optionally via switches (not shown).

Figure 2:
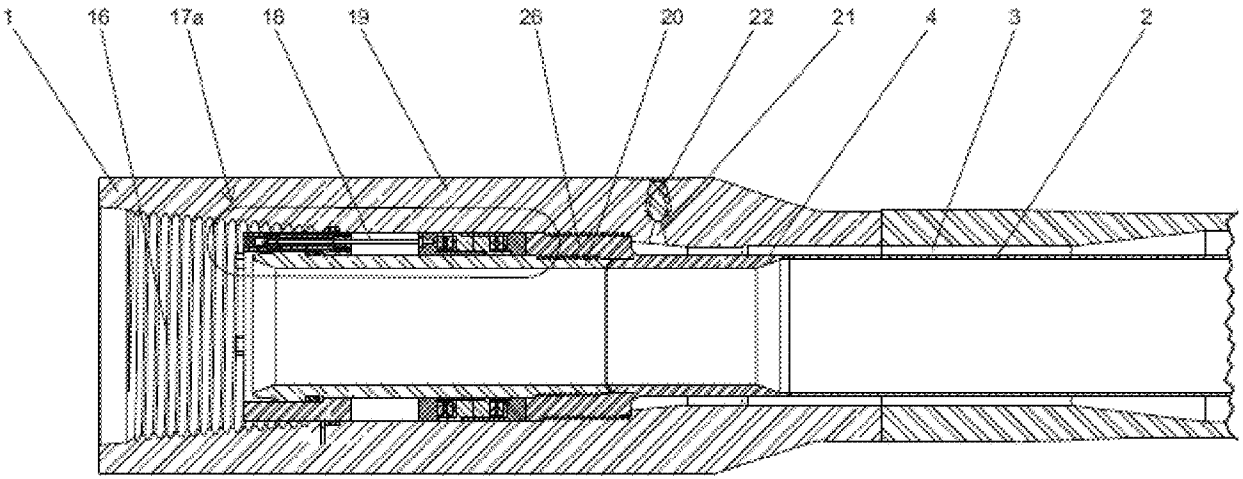
FIG. 2 shows a longitudinal section through one end of another embodiment of the drill pipe according to the invention with a conductor.

FIG. 2 shows a longitudinal section through one end of another embodiment of a drill pipe according to the invention. The drill pipe 1 in this case has a threading 16 in the end 19 referred to as a box, with which it can be connected to the end 23, referred to as a pin (FIG. 3), of another drill pipe. In addition, it has a first part of a coupling mechanism. The coupling mechanism consists of two components 17*a*, 17*b* and can be designed, for example, as explained in AT 508 272 B1. The coupling mechanism produces a galvanic connection only via the pin 18, which shifts from the first component 17*a* of the coupling mechanism to a second component 17*b* of the coupling mechanism. All other parts of the coupling mechanism are insulated from the environment. On its end facing away from the threading 16, the first component 17*a* of the coupling mechanism is galvanically connected to the conductor 4. In order to further reduce the risk of explosion and the risk of damage, the end of the conductor 4, the first component 17*a* of the coupling mechanism and their connection are insulated by additional insulation 20 inside the inner pipe 2. Hereinafter, the conductor 4 then rests on the inner pipe 2 via insulation 5 similar to what is shown in FIG. 1.

So that the hollow 3 between inner pipe 2 and drill pipe 1 is accessible even after the finishing of the drill pipe 1, at least one opening 21 is provided in the drill pipe 1, which can be closed with a closure element 22. Thus, the hollow 3 can be filled with different fillers or the latter can be exchanged corresponding to the situation and/or the desired function. Thus, for example, in applications in which it thus is to be expected that the inner pipe 2 begins to oscillate strongly, the hollow can be filled with sand in order to damp these oscillations. As an alternative, for example, ceramic balls could also be used. In other possible applications, it may be desired that the drill pipe 1 has a lifting force in the drilling fluid ("mud") that has a relatively high specific weight, which may be advantageous, e.g., in the case of horizontal drilling, in order to reduce the friction on the borehole wall. In this case, e.g., air or light oils would be a more suitable filler.

In addition, electrical devices 14 or electronically readable data media 15 can be made accessible and/or optionally exchanged or repaired via the opening 21.

Figure 3:
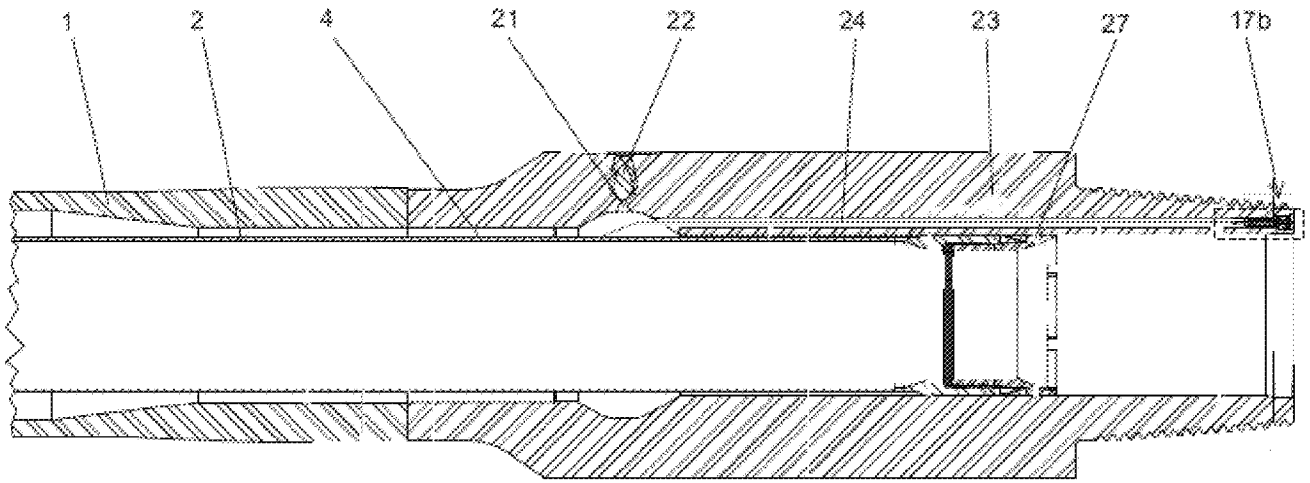
FIG. 3 shows a longitudinal section through the other end of the embodiment of the drill pipe according to the invention of FIG. 2.

FIG. 3 shows a longitudinal section through the other end, referred to as pin 23, of the drill pipe 1 of FIG. 2. The second component 17*b* of the coupling mechanism in this case produces a galvanic connection to the conductors of a subsequent drill pipe. On its side facing away from the connection, a conductor 24, for example a wire, runs to the conductor 4 located on the inner pipe 2. In order also to make possible simple access to this connection, for example for maintenance, an opening 21, which can be closed with a closure element 22, is also located here.

The invention claimed is:

1. A drill pipe for a drill string, the drill pipe comprising:

an outer body;

a pin at an end of the drill pipe;

a plurality of electrical conductors;

an inner pipe disposed inside the drill pipe, one of the electrical conductors being disposed on an outer side of the inner pipe, the outer body of the drill pipe and the inner pipe being at a distance from one another in places, defining a hollow between the outer body of the drill pipe and the inner pipe; and a coupling mechanism having one component on the inner pipe and connected to the one electrical conductor located on the inner pipe, and another component disposed on the outer body of the drill pipe and connected to the one electrical conductor located on the inner pipe via another one of the electrical conductors, the one of the electrical conductors located on the inner pipe being housed in the hollow defined between the outer body of the drill pipe and the inner pipe, and the hollow is completely sealed relative to an environment outside of the drill pipe.

2. The drill pipe according to claim 1, wherein the one of the electrical conductors is fastened on the outer side of the inner pipe.

3. The drill pipe according to claim 1, wherein the one of the electrical conductors is connected to the inner pipe on the outer side of the inner pipe.

4. The drill pipe according to claim 3, wherein the one of the electrical conductors is connected to the inner pipe on the outer side of the inner pipe over the entire length of the one conductor.

5. The drill pipe according to claim 1, wherein at least one electrical device is arranged in the hollow.

6. The drill pipe according to claim 5, wherein the at least one electrical device is a sensor.

7. The drill pipe according to claim 6, wherein the sensor is one of a temperature sensor, a pressure gauge, a terrestrial magnetic field sensor, and a strain sensor.

8. The drill pipe according to claim 1, wherein a filler is located in the hollow.

9. The drill pipe according to claim 8, wherein the filler is one of resin, silicone oil, sand, glass, and ceramic.

10. The drill pipe according to claim 8, wherein the filler has a lower specific weight than a drilling fluid that flows through the drill pipe.

11. The drill pipe according to claim 8, wherein the filler has a low thermal conductivity.

12. The drill pipe according to claim 8, wherein the filler has a low compressibility.

13. The drill pipe according to claim 8, wherein the filler has oscillation-damping properties.

14. The drill pipe according to claim 1, wherein an electronically readable input/output that is a chip is arranged in the hollow, the electronically readable input/output being connected via a switch to at least one of the electrical conductors.

15. The drill pipe according to claim 1, wherein the one electrical conductor and the other electrical conductor are separated from one another.

16. The drill pipe according to claim 15, wherein the multiple conductors are separated from one another by insulating guides.

17. The drill pipe to claim 1, wherein the one conductor and the other conductor are data conductors.

* * * * *